US009903631B2

(12) United States Patent
Buehrle et al.

(10) Patent No.: US 9,903,631 B2
(45) Date of Patent: Feb. 27, 2018

(54) REFRIGERATOR AND ICE MAKING DEVICE FOR PRODUCING AND RELEASING CLEAR ICE, AND METHOD THEREOF

(75) Inventors: Sascha Buehrle, Tuerkheim (DE); Manfred W. Staebler, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 1285 days.

(21) Appl. No.: 13/451,576

(22) Filed: Apr. 20, 2012

(65) Prior Publication Data

US 2013/0276468 A1 Oct. 24, 2013

(51) Int. Cl.
*F25C 1/20* (2006.01)
*F25C 1/18* (2006.01)
*F25C 1/10* (2006.01)

(52) U.S. Cl.
CPC ..... *F25C 1/20* (2013.01)

(58) Field of Classification Search
CPC ..... F25C 1/18; F25C 1/20; F25C 5/04; F25C 5/08; F25C 5/02; F25C 1/10; F25B 49/00
USPC ..... 62/68, 340, 342
See application file for complete search history.

(56) References Cited

U.S. PATENT DOCUMENTS

| | | | | |
|---|---|---|---|---|
| 2,595,968 | A | 5/1952 | McCoy | |
| 2,990,701 | A * | 7/1961 | Fink | 62/353 |
| 3,224,213 | A * | 12/1965 | Hoyt, Jr. | 62/68 |
| 4,178,776 | A * | 12/1979 | Baldus et al. | 62/538 |
| 6,198,407 | B1 * | 3/2001 | Koga | 340/7.58 |
| 2006/0032262 | A1 * | 2/2006 | Seo et al. | 62/340 |
| 2006/0152497 | A1 * | 7/2006 | Rekimoto | 345/173 |

FOREIGN PATENT DOCUMENTS

| | | | |
|---|---|---|---|
| JP | 1993322398 | A * | 12/1993 |
| KR | 2006014891 | A | 2/2006 |

* cited by examiner

*Primary Examiner* — Grant Moubry
*Assistant Examiner* — Harry Arant
(74) *Attorney, Agent, or Firm* — Michael E. Tschupp; Andre Pallapies; Brandon G. Braun

(57) ABSTRACT

A refrigerator and ice making device for producing and releasing clear ice and a method thereof. In an exemplary embodiment, an ice tray of the ice making device may include at least one receiving part that receives water for freezing into the clear ice, the at least one receiving part having an opening provided at a top portion thereof through which the water is supplied and the clear ice is discharged from the at least one receiving part. At least one oscillator may be disposed on the ice tray, the at least one oscillator structured to keep the water moving during the ice production process. The at least one oscillator may also be used to vibrate the ice tray to release the clear ice into a collection tray.

19 Claims, 4 Drawing Sheets

PICTURE 2 (OSZILLATOR WAVE FORM)

REFRIGERATOR AND ICE MAKING DEVICE FOR PRODUCING AND RELEASING CLEAR ICE, AND METHOD THEREOF

BACKGROUND OF THE INVENTION

1. Field of the Invention

The present invention relates to a refrigerator and ice making device and more particularly, to a refrigerator and ice making device including oscillators on the ice tray and a method thereof that is used produce and release clear ice.

2. Related Art

In the related art, ice making devices may use an ice tray which is constantly pivoting slightly to keep the water moving. To make the ice cubes, metal pins reach into the water and are cooled down below freezing wherein water freezes to the pins. When enough water is frozen, the pins with the frozen ice move out of the water tray and over a collection tray. The pins are then heated to release the ice cubes where the ice cubes drop into a collection tray. The remaining water gets pumped out of the ice maker wherein new water is supplied and the process starts again.

In the related art, however, costs associated with mechanical complexity and the energy used to pump the remaining water out of the ice maker are incurred, and an additional drain line is also required to remove the excess water from the ice maker.

Other known methods of producing and releasing ice cubes include using metal trays wherein when the ice cubes are formed, the ice cubes are heated slightly and the ice cubes are mechanically raked out of the ice trays or the ice trays are pivoted to release the ice into the collection tray. However, as above, heating the ice cubes requires energy and reduces an ice production rate due to the produced heat that is required to be removed from the ice maker prior to producing a new batch of ice cubes.

In addition to metal trays, ice cubes may be produced using twist trays wherein a flexible ice tray is twisted to release the ice cubes into a collection tray. However, flexible ice trays typically made from a plastic material are not as good of heat conductors as the metal trays, making it more difficult to freeze the water and accordingly, slowing ice cube production down. In addition, the plastic may become brittle over time and break.

The present invention introduces a refrigerator and ice maker having one or more oscillators on the ice tray to produce clear ice and also to release the clear ice into the collection tray.

SUMMARY OF THE INVENTION

A first aspect of the present invention is directed to a refrigerator including an ice making device for producing and releasing clear ice. In the first aspect, an ice tray of the ice making device may include at least one receiving part that receives water for freezing into the clear ice, the at least one receiving part having an opening provided at a top portion thereof through which the water is supplied and the clear ice is discharged from the at least one receiving part. Further, at least one oscillator may be disposed on the ice tray, the at least one oscillator structured to keep the water moving during the ice production process. The at least one oscillator may also be used to vibrate the ice tray to release the clear ice into a collection tray.

A second aspect of the present invention is directed to the aforementioned ice making device itself. In the second aspect, an ice tray of the ice making device may include at least one receiving part that receives water for freezing into the clear ice, the at least one receiving part having an opening provided at a top portion thereof through which the water is supplied and the clear ice is discharged from the at least one receiving part. Further, at least one oscillator may be disposed on the ice tray, the at least one oscillator structured to keep the water moving during the ice production process. The at least one oscillator may also be used to vibrate the ice tray to release the clear ice into a collection tray.

A third aspect of the invention is directed to a method for producing and releasing clear ice. In an exemplary embodiment, steps of the invention may include receiving water for freezing into the clear ice into an ice tray; cooling the water to a temperature below the freezing point of water; during the cooling step, vibrating the ice tray using at least one oscillator to produce the clear ice, and after the freezing step, using the at least one oscillator to vibrate the ice tray to release the clear ice from the ice tray.

The illustrative aspects of the present invention are designed to solve the problems herein described and other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various exemplary embodiments of the disclosure, in which.

Figure 1:
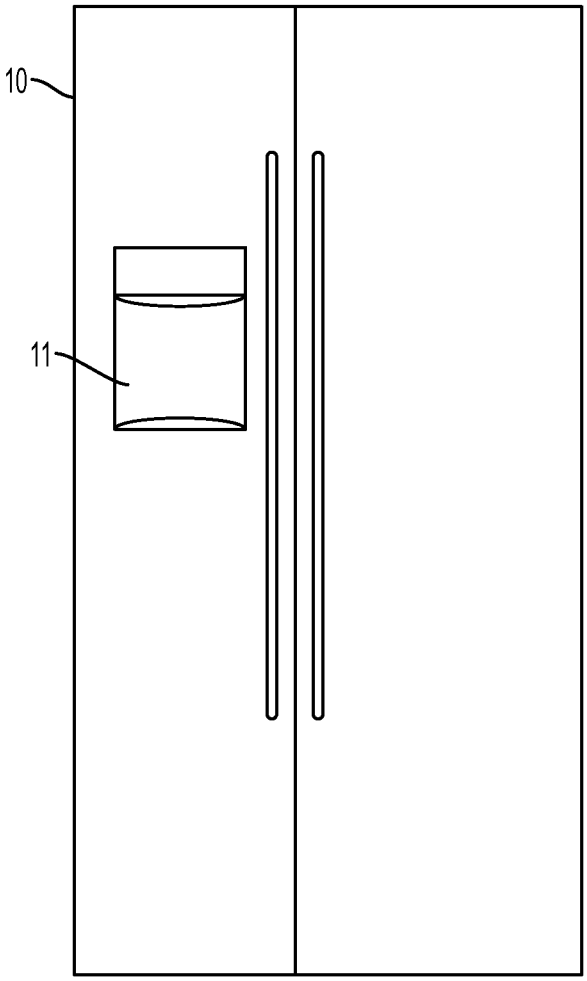
FIG. 1 depicts a refrigerator including an ice making device according to an exemplary embodiment of the invention.

The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION OF THE INVENTION

FIG. 1 shows an exemplary embodiment of a refrigerator including an ice making device according to an exemplary embodiment of the invention.

In FIG. 1, a refrigerator 10 includes an ice maker 11. It is envisioned that related art refrigerators and ice makers may be adapted to use the features described here below. However, additional structure used in the related art such as heaters used to release the ice into the collection trays, drain lines, may be eliminated using the present invention.

Figure 2:
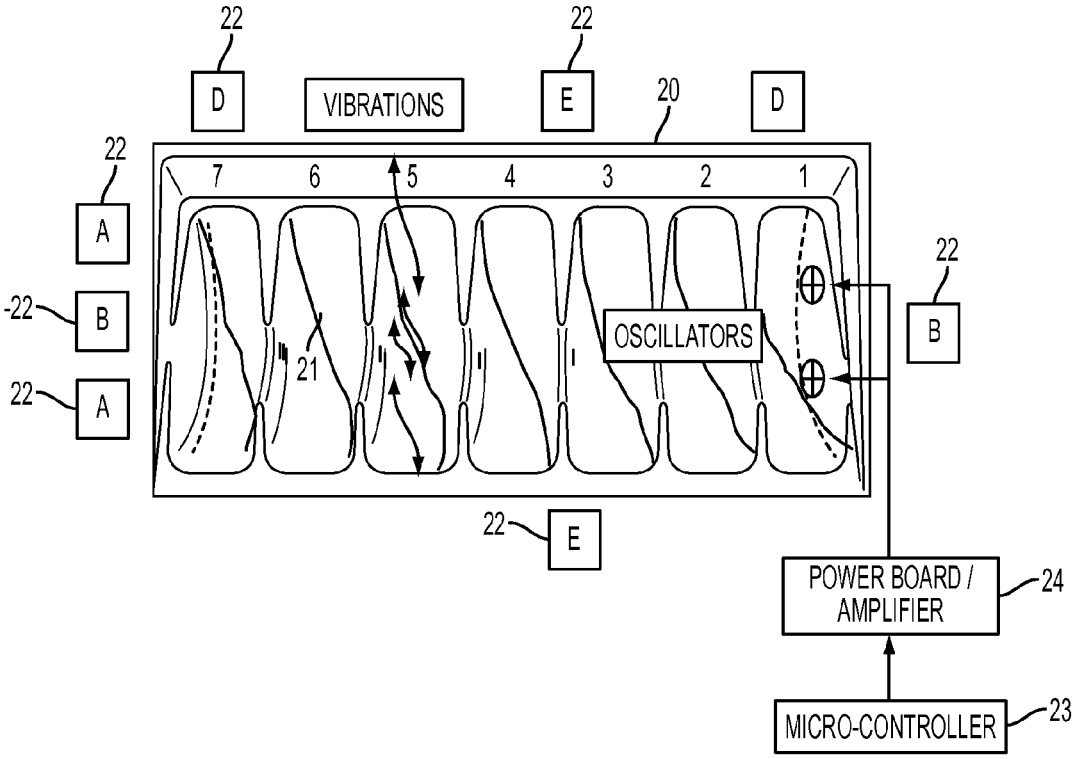
FIG. 2 depicts an ice tray of the ice making device incorporating oscillators according to an exemplary embodiment of the invention.

In the exemplary embodiment of the invention as shown in FIG. 2, the ice maker 11 may include an ice tray 20. The ice tray 20 may be made of a metallic material, although ice trays made of flexible materials are not precluded. The ice trays in exemplary embodiments should have enough stiffness so that vibrations produced by oscillators 21 described here below produce efficient movement of the water within the ice trays 20 during formation of the ice and are capable of withstanding vibrations from the oscillators 21 to eject the ice cubes from the ice trays 20.

The ice trays 20 may include at least one receiving part 21 that receives water for freezing into clear ice. The at least one receiving part 21 may have an opening provided at a top portion thereof through which the water is supplied and the clear ice is released from the at least one receiving part 21.

At least one oscillator 22 (A, B, D, E) is placed on a side or bottom of the ice tray 20 and is used to vibrate the ice tray 20. By vibrating the ice tray 20 during ice formation, clear ice can be achieved by flowing the water at temperatures below 32° F. Ultrasonic waves from the oscillators create a wave action in the standing water in the ice trays 20, simulating flowing water and allowing the ice to freeze clear and not to crystallize around trapped air bubbles. In particular, stagnant water contains trapped air bubbles. During the freezing process, water starts freezing and crystallizing around these tiny air bubbles resulting in opaque ice. Using ultrasonic waves to keep the water in motion and removing trapped air eliminates these impurities and crystallization points and allows clear ice to form.

Further, the ultrasonic waves may also be used to loosen frozen ice cubes from the ice tray 20 to release and eject the clear ice cubes produced. In the invention, the same oscillators 22 may be used at a different frequency and/or higher amplitude to eject the ice cubes from the ice tray.

The ice making device 20 may include a microcontroller 23 that controls the oscillator 22 to control the frequency of the ultrasonic waves and also a power board 24 that amplifies signals from the microcontroller to run the at least one oscillator 22.

In the invention, at least one oscillator 22 may be attached to at least one end of the ice tray 20. Alternatively, or in addition to, the at least one oscillator 22 may be attached to a bottom of the ice tray 20. In an exemplary embodiment, at least two oscillators 22 may be used. A first of the at least two oscillators 22 may be attached to an end along the length of the ice tray 20 and a second oscillator of the at least two oscillators 22 may be attached to a bottom of the ice tray 20. In this case, the first oscillator may be used to flow the water during ice production and the second oscillator placed at a bottom of the ice tray 20 may be used to eject the ice. It is preferable that the oscillators 22 be in rigid contact with the ice tray 20 in order to have the best vibration frequency transfer to the ice tray.

The vibration frequency may be adapted to the material and geometry of the ice tray 20 and/or also optimized for different water conditions such as hardness or other impurities.

While exemplary embodiments of placement of oscillators are described herein, it should be understood that the invention is not limited to these embodiments and it is envisioned that multiple configurations of the placement of the oscillators and their associated frequencies may be used. For example, positions may include variations such as: a) two oscillators on both sides of the ice tray on the long way; b) two oscillators on both sides on the ice tray in a short way (between ⅔ and ⅚ of the width of the ice tray); c) two oscillators at the bottom of the ice tray; d) two oscillators on one side (along the length of the ice tray); and e) one oscillator on each side of the ice tray (along the length of the ice tray).

Figure 3:
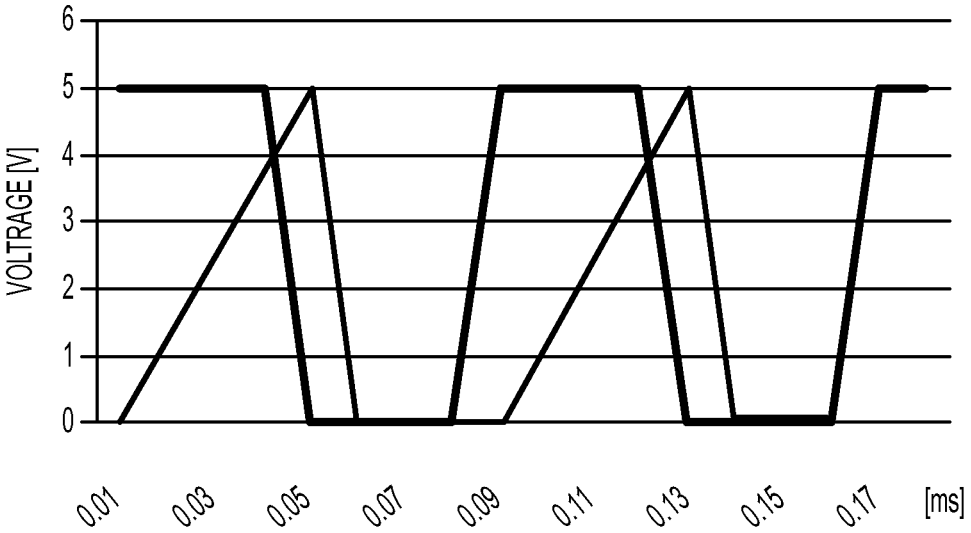
FIG. 3 depicts an oscillator wave form graph using oscillators to produce both saw-tooth wave forms and rectangular wave forms according to an exemplary embodiment of the invention.

FIG. 3 depicts an oscillator wave form graph using oscillators to produce both saw-tooth wave forms and rectangular wave forms according to an exemplary embodiment of the invention. In the FIG. 3 graph, two oscillators were used on metal ice trays to produce clear ice. A microcontroller 23 controlled the oscillators 22 and generated the frequency. Different waveforms (triangular, rectangular and saw tooth) with variable amplitude and wavelength were used to produce the clear ice with smooth surfaces. Further, the positions of the oscillators were also varied.

To produce the results of FIG. 3, the oscillators were vibrated with 11.11 kHz and the oscillators used 0.08 A. One oscillator was run with the saw tooth wave as shown and the other oscillator with the rectangular wave form.

Figure 4:
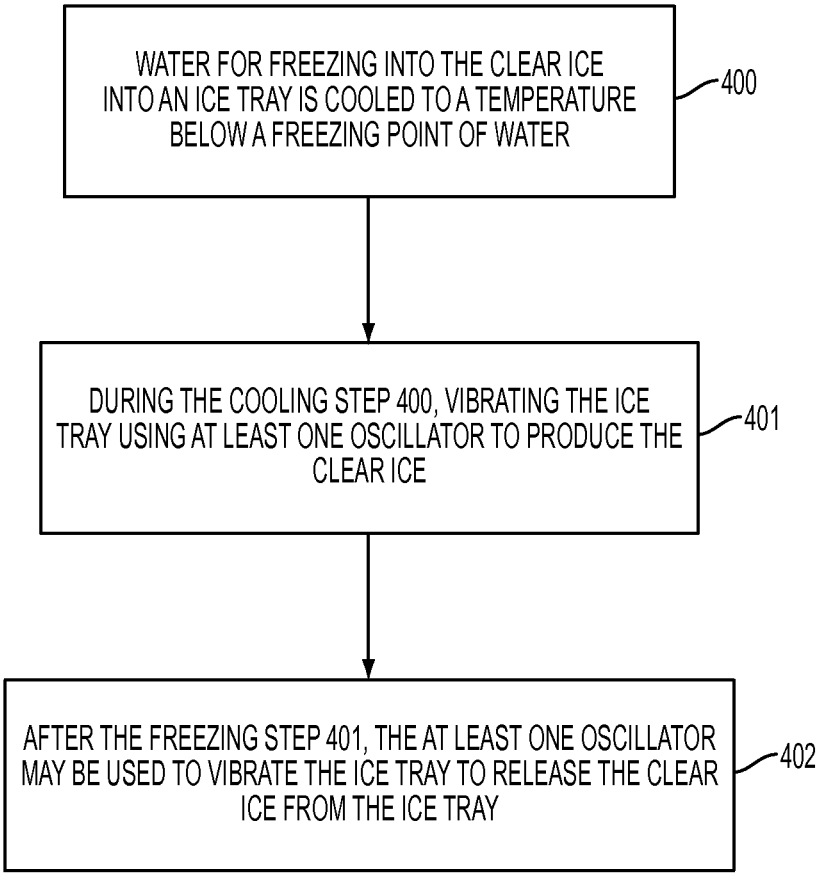
FIG. 4 depicts a method of the invention for producing and releasing clear ice according to an exemplary embodiment of the invention.

FIG. 4 depicts an exemplary method of the invention for producing and releasing clear ice. In step 400, water for freezing into the clear ice into an ice tray is cooled to a temperature below the freezing point of water. In step 401, during the cooling step 400, the ice tray is vibrated using at least one oscillator to produce the clear ice. In Step 402, after the freezing step 401, the at least one oscillator may be used to vibrate the ice tray to release the clear ice from the ice tray.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A refrigerator, comprising:

an ice making device including an ice tray, wherein the ice tray includes:

at least one receiving part that receives water for freezing into clear ice, the at least one receiving part having an opening provided at a top portion thereof through which the water is supplied and the clear ice is discharged from the at least one receiving part;

at least one oscillator disposed on the ice tray, the at least one oscillator arranged to vibrate the ice tray to keep the water moving during production of the clear ice, and the at least one oscillator being configured to vibrate the ice tray to release the clear ice from the ice tray; and a microcontroller configured to control the oscillator, wherein the microcontroller is configured to operate the oscillator at a different frequency and/or a higher amplitude when releasing the clear ice than when keeping the water moving during the production of the clear ice.

2. The refrigerator according to claim 1, wherein the ice tray is formed from a metallic material.

3. The refrigerator according to claim 1, wherein the at least one oscillator produces ultrasonic waves.

4. The refrigerator according to claim 3, wherein the microcontroller controls the frequency of the ultrasonic waves.

5. The refrigerator according to claim 4, further comprising a power board that amplifies signals from the microcontroller to run the at least one oscillator.

6. The refrigerator according to claim 1, wherein the at least one oscillator is attached to at least one end of the ice tray.

7. The refrigerator according to claim 1, wherein the at least one oscillator is attached to a bottom of the ice tray.

8. The refrigerator according to claim 1, wherein the at least one oscillator includes at least two oscillators, a first of the at least two oscillators being attached to one end along the length of the ice tray and a second oscillator of the at least two oscillators being attached to a bottom of the ice tray.

9. An ice making device, comprising:

an ice tray, wherein the ice tray includes:

at least one receiving part that receives water for freezing into clear ice, the at least one receiving part having an opening provided at a top portion thereof through which the water is supplied and the clear ice is discharged from the at least one receiving part;

at least one oscillator disposed on the ice tray, the at least one oscillator arranged to vibrate the ice tray to keep the water moving during production of the ice, and the at least one oscillator being configured to vibrate the ice tray to release the ice from the ice tray; and a microcontroller configured to control the oscillator, wherein the microcontroller is configured to operate the oscillator at a different frequency and/or a higher amplitude when releasing the ice than when keeping the water moving during the production of the ice.

10. The ice making device according to claim 9, wherein the ice tray is formed from a metallic material.

11. The ice making device according to claim 9, wherein the at least one oscillator produces ultrasonic waves.

12. The ice making device according to claim 11, wherein the microcontroller controls the frequency of the ultrasonic waves.

13. The ice making device according to claim 12, further comprising a power board that amplifies signals from the microcontroller to run the at least one oscillator.

14. The ice making device according to claim 9, wherein the at least one oscillator is attached to at least one end of the ice tray.

15. The ice making device according to claim 9, wherein the at least one oscillator is attached to a bottom of the ice tray.

16. The ice making device according to claim 9, wherein the at least one oscillator includes at least two oscillators, a first of the at least two oscillators being attached to one end along the length of the ice tray and a second oscillator of the at least two oscillators being attached to a bottom of the ice tray.

17. A method for producing and releasing clear ice comprising the steps of:

receiving water into an ice tray for freezing the water;

cooling the water in the ice tray to a temperature below the freezing point of water;

during the cooling step, vibrating the ice tray with at least one oscillator so as to produce clear ice when the water freezes, after the cooling step, vibrating the at least one oscillator to vibrate the ice tray to release the clear ice from the ice tray, wherein a microcontroller is configured to operate the oscillator at a different frequency and/or a higher amplitude when releasing the clear ice than when producing the clear ice.

18. The method for producing and releasing clear ice according to claim 17, wherein the at least one oscillator is attached to a bottom of the ice tray.

19. The method for producing and releasing clear ice according to claim 17, wherein the at least one oscillator includes at least two oscillators, a first of the at least two oscillators being attached to one end along the length of the ice tray and a second oscillator of the at least two oscillators being attached to a bottom of the ice tray.

* * * * *